United States Patent [19]

Tarbox et al.

[11] Patent Number: 4,575,075

[45] Date of Patent: Mar. 11, 1986

[54] HAND EXERCISE WEIGHTS

[75] Inventors: Max R. Tarbox, Lubbock; Nancy Rosales, Wolfforth, both of Tex.

[73] Assignee: Tarbox, Inc., Lubbock, Tex.

[21] Appl. No.: 579,060

[22] Filed: Feb. 10, 1984

[51] Int. Cl.[4] ..... A63B 21/12

[52] U.S. Cl. ..... 272/119; 2/161 A

[58] Field of Search ..... 272/119, 67, 93; D2/361; 273/54 B, 166; 2/16, 20, 159, 161 A, 170; 128/77, 80 H

[56] References Cited

U.S. PATENT DOCUMENTS

| | | | |
|---|---|---|---|
| D. 195,134 | 4/1963 | Tarbox . | |
| D. 200,415 | 2/1965 | Tarbox . | |
| D. 218,621 | 9/1970 | Scott . | |
| D. 236,044 | 7/1975 | Carter et al. | D2/361 |
| D. 259,955 | 7/1981 | Helferich | D2/361 |
| 2,011,362 | 8/1935 | Hayward | 273/54 B X |
| 3,149,839 | 9/1964 | Materia | 272/119 X |
| 3,203,006 | 8/1965 | Shirey | 2/161 A |
| 3,256,882 | 6/1966 | Huber | 128/165 |
| 3,369,258 | 2/1968 | Smith | 272/93 X |
| 3,490,766 | 1/1970 | Gardner | 272/119 |
| 3,525,141 | 8/1970 | Smith | 272/119 |
| 3,843,126 | 10/1974 | Bandy | 2/161 A X |
| 3,924,851 | 12/1975 | Winston | 272/119 |
| 4,034,979 | 7/1977 | Wester | 272/119 X |
| 4,247,097 | 1/1981 | Schwartz | 272/119 |
| 4,247,101 | 1/1981 | Gallmeyer | 272/119 |
| 4,258,914 | 3/1981 | Lalli | 272/119 |
| 4,326,706 | 4/1982 | Guthrie et al. | 272/119 |
| 4,330,120 | 5/1982 | Netti | 272/119 |

*Primary Examiner*—Richard J. Apley
*Assistant Examiner*—Robert W. Bahr
*Attorney, Agent, or Firm*—Dowell & Dowell

[57] ABSTRACT

Exercise weights which may be comfortably worn on a person's hand in order to aid in the development of the arm and upper body muscles. The exercise weights include a continuous band member which is fitted to encircle either hand and which includes a single fastening strap and an open slot therein through which the person's thumb is inserted when the band member is placed on the hand. The band member includes weight retaining pouches which are disposed so as to be positioned in juxtaposed relationship to the palm and back of the hand when the weights are being worn.

5 Claims, 3 Drawing Figures

HAND EXERCISE WEIGHTS

BACKGROUND OF THE INVENTION

1. History of the Prior Art

In applicant's co-pending application Ser. No. 579,061 filed February 10, 1984 of the same title as the present application, prior art developments in the field of exercise weights are discussed. The introduction of body worn weights has made it possible to permit muscle toning during periods of normal activity and physical exercise.

With the hand exercise weights of applicant's co-pending application, hand worn weights are disclosed which offer an additional advantage over other hand worn exercise weights. Specifically, applicant's prior hand weights were designed to provide more comfort to the person using the weights as well as to permit a freer use of the hands. Such weights are constructed in the form of an elongated band member having fastening means for joining the ends together when the band is worn on a persons' hand. A central opening is provided to permit the user's thumb to be extended therethrough. The opening encircles the base of the thumb and prevents the band member from shifting on the hand during periods of physical activity.

Although applicant's co-pending structure offers advantages over prior art hand worn weight devices, such structure requires fastening means to secure the ends of the band member together. In the preferred embodiment, a pair of fastening means must be adjusted in order to ensure a comfortable fit of the weight devices to the hands. This fastening and adjustment of the free ends of the band member may be, at times, somewhat awkward.

SUMMARY OF THE INVENTION

A weighted exercise device for wearing on a person's hand including a continuous band member having a slot formed therein which extends from the rear portion thereof toward and terminates in spaced relationship to the front portion thereof. The band member includes a pair of spaced weight retaining pockets which are positioned on opposite sides of the slotted opening which is adapted to permit the user's thumb to be inserted therethrough. The edges which define the sides of the slotted opening may be shaped so as to be complementary to the shape of the base of the thumb. An adjustable strap member is attached to the rear portion of the band member so as to be positioned to close the slotted opening behind the thumb in order to secure or adjust the fit of the exercise device to the person's hand.

It is a primary object of this invention to provide weighted exercise bands which may be adjustably worn on a person's hands in order to aid in the development and toning of the arms and upper body muscles.

It is another object of this invention to provide a weighted exercise band which may be comfortably secured and retained in position around a person's hands by mounting the band so as to encompass the thumb of the hand thereby preventing shifting of the exercise device relative to the hand during periods of exercise or other hand movement.

It is a further object of the invention to provide a weighted exercise or training device which is worn on a person's hands and which is opened along the front and rear portions thereof so as to both permit air flow between the band and the user's hand and to permit unrestricted movement and use of the fingers and wrists when the band is being worn.

It is another object of the invention to provide weighted exercise bands for wearing around a person's hand wherein the weights are generally equally distributed on both sides of the hand adjacent the palm and back of the hand and are comprised of a plurality of individual small weighted particles that are loosely contained so as to permit a limited movement of the particles. In this manner, the weights will conform to the surface characteristics of a person's hand during use.

It is another object of this invention to provide a hand worn exercise device which may be slipped into position on a person's hand with the thumb positioned in the elongated slot after which the device may be secured in place by the operation of a single fastening means.

DESCRIPTION OF THE PREFERRED EMBODIMENT

Figure 1:
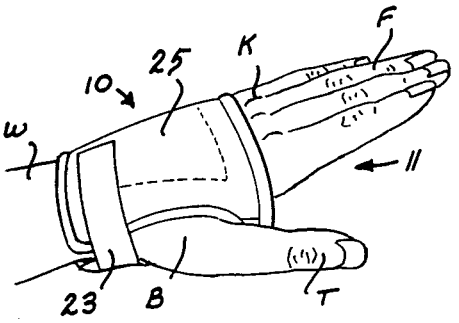
FIG. 1 is an illustration of the invention as worn on a person's left hand.

With continued reference to the drawings, the weighted exercise device 10 is shown in FIG. 1 as it is worn on a person's left hand H. In use, the exercise device extends around the hand and is positioned generally between the person's wrist W and the area adjacent the knuckles K along the base of the fingers F.

Figure 2:
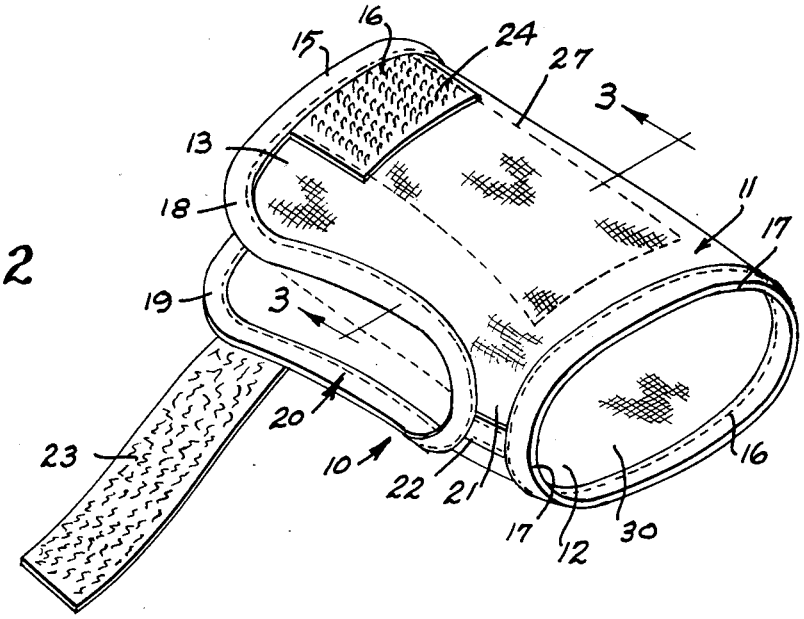
FIG. 2 is a left side perspective of the weighted exercise device of the present invention.

As shown in FIG. 2, the exercise device 10 includes a continuous band 11 constructed of a flexible fabric material such as nylon. The band includes inner and outer fabric layers or portions 12 and 13, respectively, which are sewed together or otherwise joined at the edges to form a continuous seam. In order to protect and reinforce the outer edges of the inner and outer fabric portions 12 and 13, a separate narrow fabric piping or border member 16 is sewed or otherwise secured over the edges.

The band 11 is defined having a continuous generally circular front wall 17 and a rear wall 15. The rear wall is not continuous but rather has a pair of corner portions 18 and 19 which are in generally overlapping relationship with one another. The corner portions define the beginning of a slotted opening 20 which extends from the rear wall toward the front wall. The slot 20 terminates at a point which is spaced from the front wall by a bridging portion 21 of the band 11. The edges 21 defining the slot 20 are also reinforced by the piping or border member 16.

As shown in FIG. 2, the edges 21 defining the slotted opening 20 are of the same configuration and may be tapered inwardly along their length to more closely fit the base B of the thumb T of the hand of a person using the exercise device. The band member may be formed by joining the ends of a sheet like configuration at the area of the bridge portion 21 as shown by stitching 22. The front and rear walls are constructed so that the rear portion of the band will encircle the base of the person's hand adjacent the wrist and the front portion will encompass the full width of the hand adjacent the knuckles.

Figure 3:
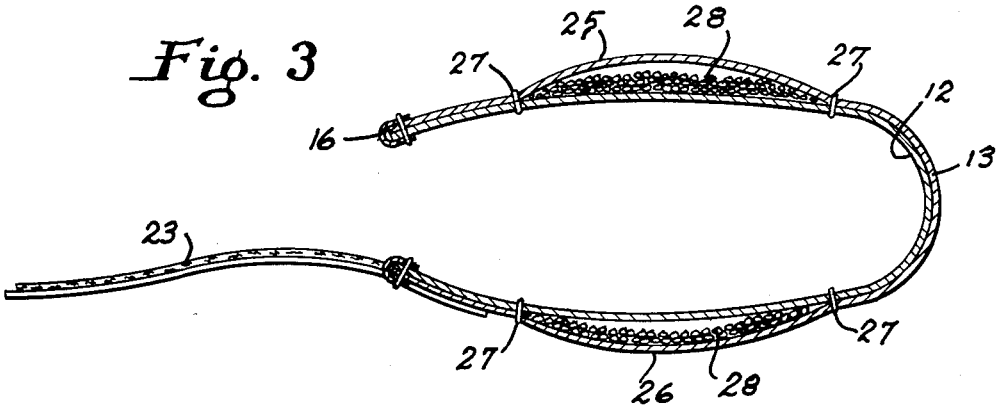
FIG. 3 is an enlarged cross-sectional view taken along lines 3—3 of FIG. 2.

In order to secure the exercise device to a person's hand, a single fastening strap 23 is secured to the outer material layer 13 adjacent one of the corner portions 18 or 19 of the continuous band member as shown in FIG. 3. The strap member has a lower surface portion covered with a material which is engageable with hook like Velcro elements which are formed on a pad 24 which is secured to the outer surface 13 adjacent the other corner portion and extending generally along and adjacent the rear wall of the band. It is contemplated that other strap means or fastening means such as more conventional buckle elements could be used to secure the band around the person's hand. In use, the strap member will function as a selectively adjustable bridging member to make the band member continuous on the back side of a person's thumb when the device is being worn.

To positively retain the exercise device in proper position on a user's hand, the slotted opening 20 is provided to permit the thumb of a person's hand to be inserted therethrough and is of a size to restrict the movement or shifting of the band member 11 with respect to the hand when the adjusting strap 23 is engaged with the Velcro pad.

The exercise device of the present invention incorporates weight retaining pouches 25 and 26 which are formed between the inner and outer material portions 12 and 13 on opposite sides of the opening 20 so that such pockets are oriented in proper position to be situated adjacent the palm and the back of the hand, respectively, when the weight device is worn on a person's hand. As shown in FIG. 3, the pockets 25 and 26 are formed by stitching the inner and outer material layers together along a periphery as shown at 27. Prior to completely stitching the periphery a plurality of spherical weighted particles such as metal shot 28 are positioned within the pockets to thereby provide a weight which is free flowing within the pocket. Some excess space is provided within the pocket, as shown at 29, in order to permit the weighted particles to shift relative to one another during use so that the weights are closely contoured to the person's hand.

Although it is not shown in the drawings, it is envisioned that the weight retaining pockets 25 and 26 may be formed having a selectively operable opening such as a zipper therein which may be formed along the periphery 27 and which can be selectively opened in order to permit the introduction or removal of additional weighted particles into the pockets. In this manner the amount of weight carried by the exercise device may be selectively adjusted.

In use, the exercise band is extended outwardly and the person's hand is inserted from the rear wall and toward the front wall of the band through the enlarged central opening 30 which is defined by the continuous band. The thumb of the hand is inserted upwardly through the slot 20. Thereafter, the opposed corner portions 18 and 19 of the band 20 are folded or brought into close relationship to one another. The strap 23 is subsequently pulled tight and placed into selective engagement with the locking hooks of the Velcro pad 24. Once the exercise device has been securely placed on the hand, a person is free to perform exercises including jogging, aerobics, and the like without the exercise device slipping from aligned engagement with the hand. As the front edge of the exercise device encircles the hand at the base of the fingers, air is permitted to flow between the exercise device and the surface of the user's hands. The movement of air between the exercise device and the hand makes the exercise device more comfortable and will prevent the build up of excessive moisture caused by perspiration. With the exercise band in place,the weights are positioned adjacent the palm and back of the hands and the person's fingers and wrist are free of obstructions.

The exercise device as shown in the drawings is constructed for use on a person's left or right hand. When worn on the left hand, the fastening strap will be disposed as shown in FIG. 1 on top of the wrist. When the exercise device is worn on the right hand, the strap will extend along the lower portion of the wrist.

We claim:

1. An exercise device to be selectively worn around either of a person's hands comprising a continuous band body member having inner and outer surface portions, said body member being defined having front and rear edge portions, said front edge portion being continuous, an elongated slotted opening disposed in said band member and extending from said rear edge portion toward said front edge portion, said slotted opening being spaced from said front edge portion by a bridging portion of said body member, said slotted opening having opposing side wall portions having substantially the same configuration, first and second weight means carried by said body member and disposed in generally overlapping relationship with one another so as to be oriented adjacent the palm and back of a person's hand, and fastening means spaced from said bridging portion of said body member for securing said first and second side walls portions of said slotted opening in adjusted relationship with one another when said elongated body member is placed around a person's hand with the person's thumb positioned in said slotted opening.

2. The exercise device of claim 1 in which said first and second weight means are generally equally distributed so that the overall weight of the exercise device is generally equally distributed along the back and palm side of a person's hand.

3. The exercising device of claim 2 in which said first and second weight means consist of a plurality of individual small particles which are mounted within first and second pouches so as to be shiftable within said pouches, said first and second weight means being conformable to the surface characteristics of a person's hands.

4. The excercise device of claim 3 in which said side wall portions of said slotted opening are tapered inwardly of said body member and away from one another along a portion of their length so as to form a contour complementary to the shape of the base of a person's thumb.

5. The exercise device of claim 4 in which said fastening means includes a strap means attached to said body member adjacent the rear edge portion and extending outwardly from one of said side wall portions of said slotted opening, said strap means being selectively engageable with engaging means secured to said body member adjacent the rear edge portion and extending inwardly from said slotted opening.

* * * * *